United States Patent [19]

Ikezaki et al.

[11] Patent Number: 4,592,764

[45] Date of Patent: Jun. 3, 1986

[54] VACUUM CLEANER

[75] Inventors: Katuzi Ikezaki, Sakai; Kiyoshi Ishii, Nishinomiya, both of Japan

[73] Assignee: Sharp Kabushiki Kaisha, Osaka, Japan

[21] Appl. No.: 598,675

[22] Filed: Apr. 10, 1984

[30] Foreign Application Priority Data

| | | | |
|---|---|---|---|
| Jun. 30, 1983 | [JP] | Japan | 58-103269[U] |
| Jun. 30, 1983 | [JP] | Japan | 58-103270[U] |
| Jun. 30, 1983 | [JP] | Japan | 58-103271[U] |
| Jun. 30, 1983 | [JP] | Japan | 58-103272[U] |
| Sep. 2, 1983 | [JP] | Japan | 58-136934[U] |
| Sep. 2, 1983 | [JP] | Japan | 58-136935[U] |
| Sep. 14, 1983 | [JP] | Japan | 58-143360[U] |
| Sep. 16, 1983 | [JP] | Japan | 58-144415[U] |
| Sep. 19, 1983 | [JP] | Japan | 58-145502[U] |

[51] Int. Cl.[4] ..... B01D 46/04; A47L 9/12; A47L 9/20; A47L 9/22

[52] U.S. Cl. ..... 55/276; 55/305; 55/323; 55/356; 55/358; 55/482; 55/DIG. 3; 15/323; 15/326; 15/327 E; 15/327 F; 15/347; 15/352; 15/412

[58] Field of Search ..... 55/276, 305, 304, 323, 55/356, 358, 472, 482, DIG. 3; 15/323, 326, 327 R, 327 E, 327 F, 347, 352, 412

[56] References Cited

U.S. PATENT DOCUMENTS

| | | | |
|---|---|---|---|
| 2,591,305 | 4/1952 | Segesman | 15/327 E |
| 2,997,728 | 8/1961 | Gaudry | 15/323 |
| 3,447,189 | 6/1969 | Szabo | 15/323 |
| 3,591,888 | 7/1971 | Takeda et al. | 15/323 |
| 3,614,860 | 10/1971 | Grellsson | 15/326 |
| 3,999,640 | 12/1976 | Persson | 15/323 |

FOREIGN PATENT DOCUMENTS

| | | | |
|---|---|---|---|
| 2729259 | 1/1979 | Fed. Rep. of Germany | 15/323 |
| 38164 | 4/1978 | Japan | 15/326 |
| 93660 | 8/1978 | Japan | 15/326 |
| 15363 | 2/1979 | Japan | 15/323 |
| 68060 | 5/1979 | Japan | 15/323 |
| 98051 | 8/1979 | Japan | 55/472 |

*Primary Examiner*—David L. Lacey

*Attorney, Agent, or Firm*—Birch, Stewart, Kolasch & Birch

[57] ABSTRACT

A body of a vacuum cleaner comprising three subassemblies, i.e., a front subassembly, a central subassembly, and a rear subassembly. The front subassembly stores the matter drawn through a suction port formed in a suitable position. The central subassembly can be connected and disconnected with the front subassembly and has an evacuating device therein. The rear subassembly is connected to the central subassembly by coupling members and acts to cover the back side of the evacuating device incorporated in the central subassembly.

14 Claims, 17 Drawing Figures

VACUUM CLEANER

BACKGROUND OF THE INVENTION

The present invention relates to a vacuum cleaner and, more particularly, to improvements in the assembly structure of the body of a vacuum cleaner. Also, the invention relates to improvements in the internal structure of the cleaner that are made in connection with the improvements in the assembly structure of the body.

The conventional vacuum cleaner has been so designed so that the body can be separated either into a front portion and a rear portion or into an upper portion and a lower portion to support and receive its motor unit and cord reel unit in the rear or lower portion of the body. In order to hold these units inside of the body, it has been required that complex support ribs be provided within the rear or lower portion of the body. Further, in metal molds for molding the cleaner out of plastic, the inner structure of the molds corresponding to the rear or lower portion of the body has been made complex to facilitate mold release in the molding operation. For these reasons, sinks tend to form on the outer surface of the conventional cleaner during the molding operation, thereby prolonging the cooling time for the molding operation. This prevents a simplification of the molding operation and undesirably raises the cost of manufacture. In addition, the motor unit, cord real unit, etc. disposed within the body of the conventional vacuum cleaner have been complex in structure.

SUMMARY OF THE INVENTION

It is an object of the present invention to provide a vacuum cleaner whose body consists of three subassemblies, i.e., a front subassembly, a central subassembly, and a rear subassembly, that can be assembled into a unit to eliminate the foregoing problems associated with the prior art appliances, thereby curtailing the cost to manufacture the body and simplyfying the molding operation.

It is another object of the present invention to provide a vacuum cleaner which includes a case for receiving the drawn in dust, an exhaust body, a clamping mechanism mounted in the exhaust body to effectively utilize the inner room of the case as a storage space holding the drawn in dust, and which can prevent the formation of sinks on the outer surface of the case due to molded ribs and can also eliminate the factors involved in air leakage.

It is a further object of the present invention to provide a vacuum cleaner which has a cord reel unit, a cord reel cover serving to cover and hold the cord reel unit in such a way that the cord reel unit is shielded from the wind, and an opening formed in the body and cooperating with a part of the cover to form a cord removal port.

It is still another object of the invention to provide a vacuum cleaner in which the outer periphery of the fan cover of the motor unit is pressed against the exhaust body via shock-absorbing material to fully absorb vibration, reducing noise, and in which a reduced number of support ribs are required thus preventing sinks from forming on the outer surface of the cleaner.

It is yet another object of the present invention to provide a vacuum cleaner where a moter-driven blower is mounted and fixed using a cord reel cover when the cover is mounted.

It is an additional object of the present invention to provide a vacuum cleaner which includes a device for locking the cord reel, a device including an unlocking button capable of being depressed inward and straight, an unlocking lever that is rotated to unlock the cord reel when the button is depressed, and a thin-walled hinge at one end of the unlocking lever, the unlocking button being molded out of a synthetic resin, integral with the unlocking lever.

It is still a further object of the present invention to provide a vacuum cleaner which includes a prefilter having a filter surface at least on its front side and a partition wall serving to cover the rear portion of the filter surface from the top to both sides, a main filter disposed at the back of the prefilter, a fine dust-collecting chamber formed between the filters and being open at its lower side such that the prefilter makes contact with the inner surface of a dust case only at its bottom to remove the aesthetic problems associated with the appearance of the cleaner and whereby fine dust can be easily treated when the filter unit is taken out.

It is still a further object of the present invention to provide a vacuum cleaner whose body has bosses which protrude laterally and in which the axles of rear wheels are inserted, and notches which are formed at the upper ends of both walls of a storage case and in which the bosses fit, to provide a case for receiving accessaries such as dust suction hoses, extension tubes, and a floor cleaning attachment.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

In the vacuum cleaner according to one embodiment of the invention, the body of the cleaner consists of three subassemblies, i.e., a front subassembly for storing the dust drawn through a suction port that is formed in an appropriate position, a central subassembly that can be connected and disconnected with the front subassembly and has an evacuating device disposed therein, and a rear subassembly connected to the central subassembly by means of coupling members and serving to cover the back side of the evacuating device incorporated in the central subassembly.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 1:
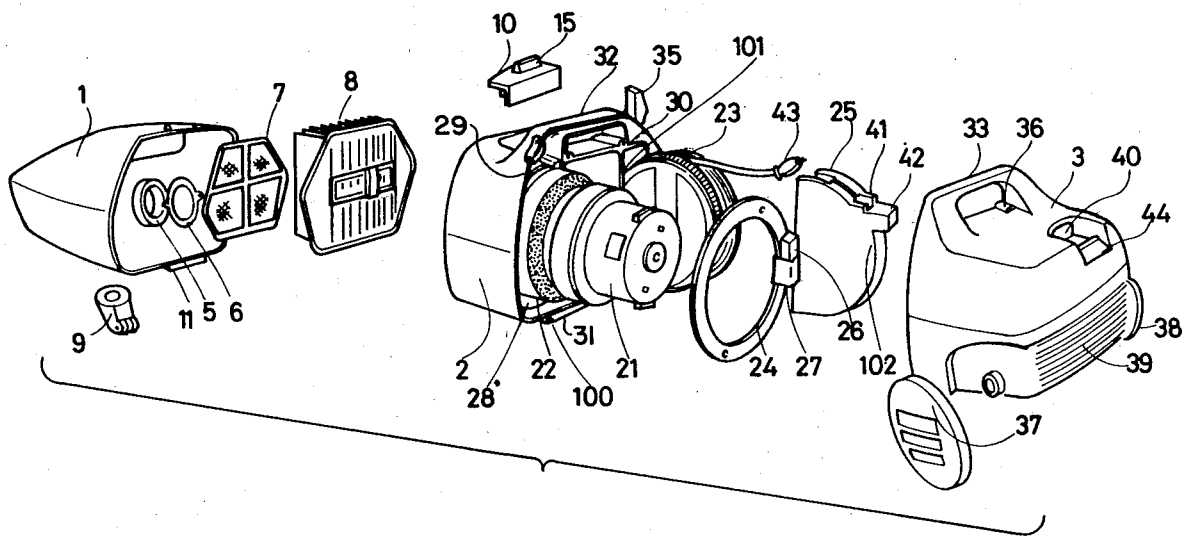
FIG. 1 is an exploded perspective view of a vacuum cleaner according to the present invention.
Figure 2:
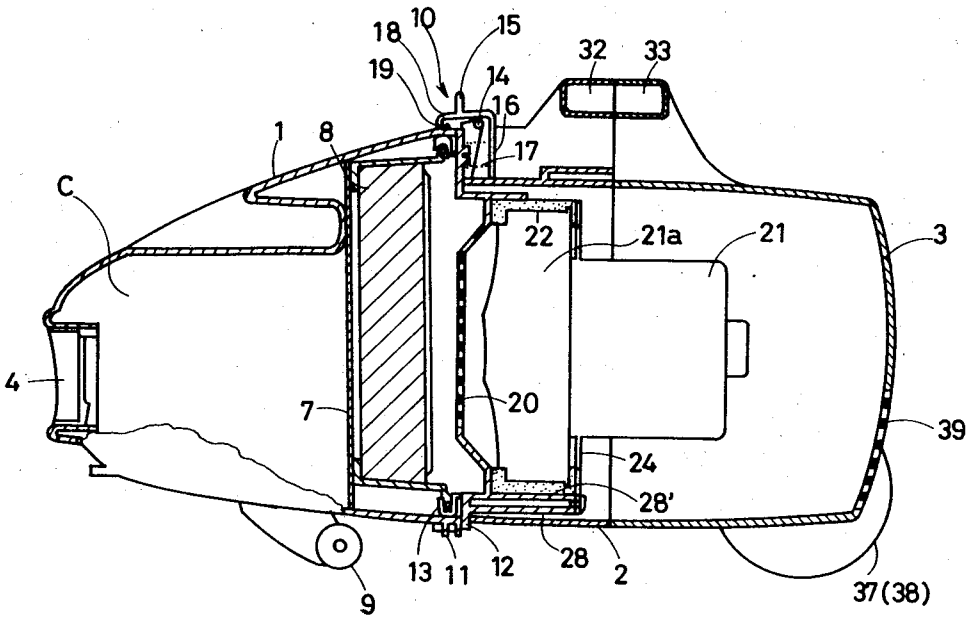
FIG. 2 is a schematic cross section of the cleaner shown in FIG. 1.

A vacuum cleaner embodying the concept of the invention is now described with reference to FIGS. 1 and 2, where FIG. 1 is an exploded perspective view of the cleaner and FIG. 2 is a schematic side elevation in cross section of the cleaner. The body of this cleaner consists of a front subassembly 1 that is provided on the suction side so as to act as a case for collecting dust, a central subassembly 2 disposed on the exhaust side, and a rear subassembly 3. These three subassemblies are coupled together to constitute the body. The front subassembly 1 acts as a container to store the dust which is drawn through a suction port 4 formed at the front end. Mounted on the bottom of the front subassembly is a swivel leg wheel 9 which can be directed toward any direction in a range of 360°. A suction O ring 5 is disposed opposite to the suction port 4 inside the front subassembly 1, and is screwed to the subassembly 1 via a retaining ring 6. A net prefilter 7 and main filter 8 are detachably mounted in the opening in the front subassembly 1. Inside of the front subassembly 1, a storage space C for receiving and storing the drawn in matter is formed between the suction port 4 and the prefilter 7.

The front subassembly 1 of the body can be connected and disconnected with the central subassembly 2 by means of a clamping mechanism including a clamp 10 which is provided at the front upper end of the central subassembly 2. The lower end of the front subassembly 1 near the opening is provided with a protrusion 11 which is brought into engagement with a hole formed in an anchoring projection 12 that is formed at the lower front end of the central subassembly 2 when the front subassembly 1 is connected to the central subassembly 2. Mounted on the fringe of the exhaust side of the main filter 8 is a filter O ring 13 that makes contact with the vicinity of the opening in the front subassembly 1 to seal the vicinity of the main filter 8.

The substantially U-shaped clamp 10 which has a thumbpiece 15 at its top is secured to a shaft 14 that is provided at the upper end of the central subassembly 2. The clamp 10 also has an engaging hook 18 protruding outwardly from the central subassembly 2. A spring 17 is mounted between the upper end of the central subassembly 2 and the portion 16 of the clamp 10 which is on the central subassembly side to bias the clamp 10 in such a direction that the hook 18 of the clamp 10 may be angularly displaced toward the inside of the central subassembly 2. A protrusion 19 is formed on the outer periphery of the opening in the front subassembly 1 and at a position corresponding to the clamp 10. The front subassembly 1 is firmly secured to the central subassembly 2 by bringing the hook 18 of the clamp 10 into engagement with the protrusion 19 while the anchoring projection 12 is caught on the projection 11. If the thumbpiece 15 of the clamp 10 is pushed horizontally, the clamp 10 rotates about the shaft 14 to disengage the hook 18 from the protrusion 19, thereby separating the front subassembly 1 from the central subassembly 2. Since the clamping mechanism including the clamp 10 placed into engagement with the protrusion 19 on its outer side is disposed in the central subassembly 2 as described above, the clamping mechanism dispenses with the space for receiving the clamping mechanism. Further, the effective volume in the front subassembly 1 for storing the drawn matter can be made larger than the cleaner where the clamp 10 is mounted in the front subassembly.

The central subassembly 2 of the body is provided with a suction port 20 opposed to the main filter 8. A motor unit 21 acting as an evacuating device is fixed with screws on the back side of the suction port 20 via a vibration isolator 22 made of rubber and a retaining ring 24. A cord reel unit 23 is covered by a cord reel cover 25 and inserted in a side-to-side relation to the motor unit 21, which is separated from the unit 23 by a rib 101. One side surface of the cover 25 is provided with a protrusion 26 which is caught in a hook portion 27 of the retaining ring 24 that is fixed using screws. Thus, the cord reel unit 23 is fixed together with the motor unti 21 via the cord reel cover 25 that also acts to screen off the exhaust gas. In this way, the motor unit 21 and the cord reel unit 23 are mounted in the central subassembly 2. A rib 28 for screwing the ring 24 to the central subassembly 2 and other parts are provided inside the central subassembly 2. A handle portion 32 is molded integrally with the central subassembly in the upper portion of the subassembly 2, and is coupled to a handle portion 33 of the rear subassembly 3 to constitute the handle of the body of the cleaner. Mounted near the handle portion 32 are a body switch 34 and an unlocking button 35 for the cord reel unit 23. Formed at the inner side of the handle portion 32 are screw guides 29 and 30 in which screws for connecting the central subassembly 2 to the rear subassembly 3 are inserted. Similar screw guides 31 are formed in the lower portion of the central subassembly 2. When the end surface of the opening on the side of the handle portion 32 is caused to face the contact surface of the rear subassembly 3, for example, under the condition that the motor unit 21 and the cord reel unit 23 are mounted in the central subassembly 2, the screw guide 30 is opposed to a tapped portion 36 in the rear subassembly 3. The central subassembly 2 and the rear subassembly 3 of the body are connected together by bringing the contact surfaces of the central subassembly 2 and of the rear subassembly 3 into abutting engagement with each other, then inserting screws acting as coupling members into the screw guides 29, 30, 31, etc., and securing screws to tapped portions corresponding to the screw guides. During use of the cleaner, the front subassembly 1 and the rear subassembly 3 are separated from each other as the need arises. However, the central subassembly 2 and the rear subassembly 3 are inseparably joined together after mounting the motor unit 21 and the cord reel unit 23 in the process of manufacture. It is to be noted that the aforementioned retaining ring 24 can be replaced by an arm in the form of an arc.

The rear subassembly 3 of the body is a container that covers both the motor unit 21 and the cord reel unit 23 which have been mounted in the central subassembly 2. The upper portion of the rear subassembly 3 is provided with the above-described handle portion 33, while the rear portion is formed with an exhaust port 39. Wheels 37 and 38 are mounted to the bottom of the rear subassembly 3. An opening 40 for constituting a plug takeout port is formed in the upper rear portion of the rear subassembly 3.

Figure 3:
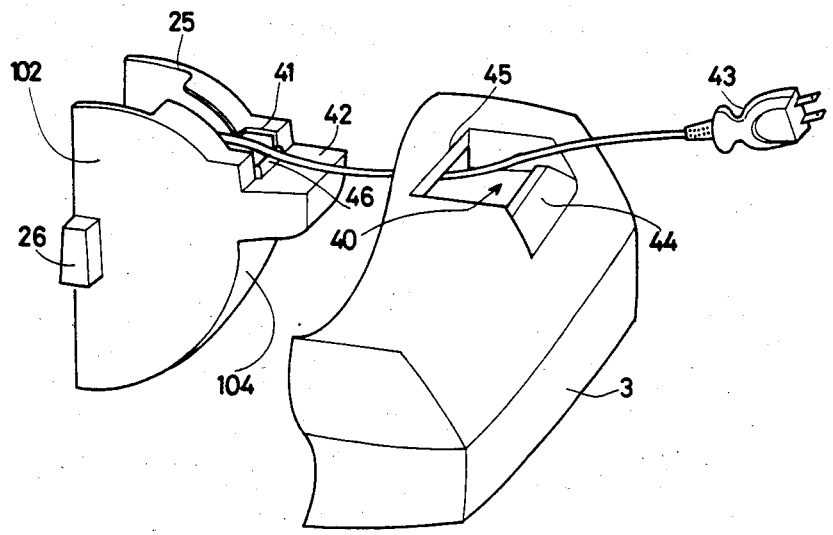
FIG. 3 is a perspective view of the cord reel cover and a part of the rear subassembly of the cleaner body shown in FIG. 1.
Figure 4:
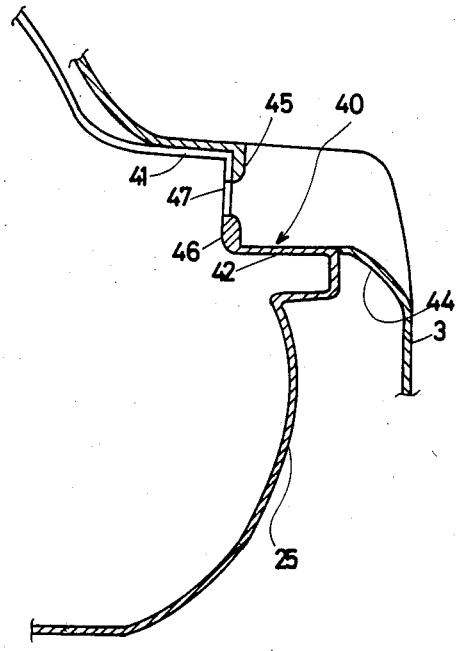
FIG. 4 is a fragmentary cross section in the vicinity of the opening in the rear subassembly of the cleaner body shown in FIG. 1 after a cord takeout port has been formed therein.

Referring next to FIG. 3, the cord reel cover 25 has a semicircular side portion 102 that covers both sides of the cord reel unit 23 and a circumferential portion 104 that covers the cord take-up surface of the reel unit 23. The circumferential portion 104 is partially formed with a circumferential notch which is terminated by a step 41 abutting on the inner surface near the opening 40. A projection 42 extends horizontally from the vicinity of the center of the circumferential portion 104 near the step 41. A projection 46 which is formed on the projection 42 is close to both the notch in the circumferential portion 104 and the step 41. Before the rear subassembly 3 of the body is connected to the central subassembly 2, the cord is pulled out from the cord reel unit 23, and a plug 43 attached to the front end of the cord is brought outwardly of the opening 40 whose size is just large enough to permit the plug 43 to pass through it. The vicinity of the opening 40 when the rear subassembly 3 is connected to the central subassembly 2 is shown in FIG. 4 in cross section. Under this condition, the front end of the projection 42 abuts on an anchoring portion 44 lying at the back of the opening 40, and the step 41 abuts on the back side of an anchoring portion 45 that is formed above the opening 40, so that a cord takeout port 47 is formed between the protrusion 46 on the projection 42 and the anchoring portion 45. The protrusion 46 limits the size of the plug takeout port 47 so that the plug 43 may not be withdrawn inwardly of the takeout port 47 when the cord is pulled in, and it acts as a stopper for the plug 43. As described already, the cord reel cover 25 holds the cord reel unit 23 and covers the rear portion of this unit. Therefore, the cover is capable of shielding exhaust gas, thus preventing the minute dust passed through the main filter 8 from adhering to the cord reel unit 23. Also, a separate cord stopper is not needed, because the opening 40 in the rear subassembly 3 cooperates with the projection 42 to form the plug takeout port 47 that serves as the cord stopper.

The structure for mounting the motor unit 21 and the cord reel unit 23 in the central subassembly 2 of the body is next described in detail. Inside the central subassembly 2, an annular support rib 28′ acting to support the motor unit 21 is formed integrally with the member that forms the suction port 20. A vibration suppressor 22 made of rubber is connected to the whole outer surface of a fan cover 21*a* of the motor unit 21. A fan motor is included in the motor unit 21, and is loosely inserted in the retaining ring 24 that is screwed using a rib 28. The hook portion 27 is formed integrally with the ring 24 and protrudes from its upper surface outwardly of its outer periphery. The ring 24 abuts on the back side of the cover 21*a*, and is secured to rib 41 with screws. Thus, the motor unit 21 is pressed on the inner surface of the support rib 28′ and securely fixed. The cord reel unit 23 is covered by the cord reel cover 25 and inserted in side-to-side relation to the motor unit 21. One side of the cover 25 is provided with the engaging protrusion 26. When the motor unit 21 is fixed, the protrusion 26 is caught in the hook portion 27 for the retaining ring 24, and then the ring 24 is secured with screws. Thus, the cord reel unit 23 is fixed via the cover 25 to the motor unit 21. As described previously, the support rib 28′ is supported in a cantilevered fashion, and is pressed against the inner surface of the rib 28 by the use of the screws. Accordingly, vibration can be effectively suppressed.

Figure 5:
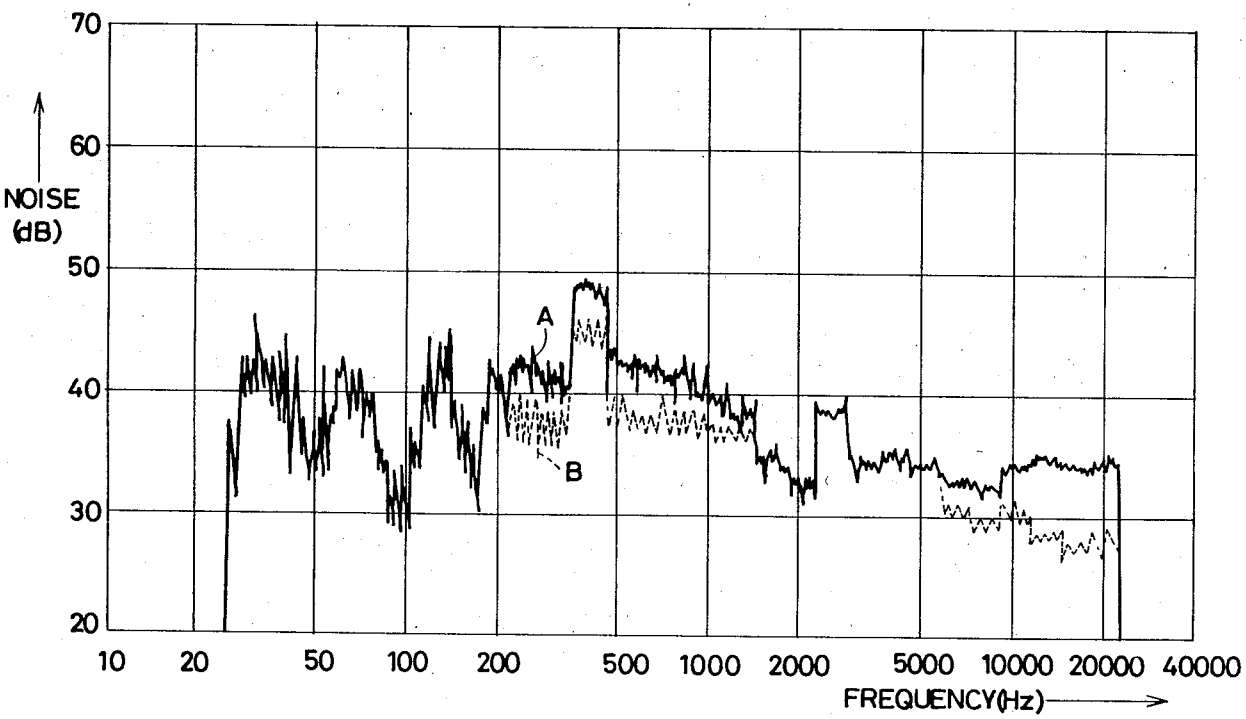
FIG. 5 is a graph showing the characteristic of noise level against frequency when comparing a conventional vacuum cleaner and the cleaner shown in FIG. 1.
Figure 6:
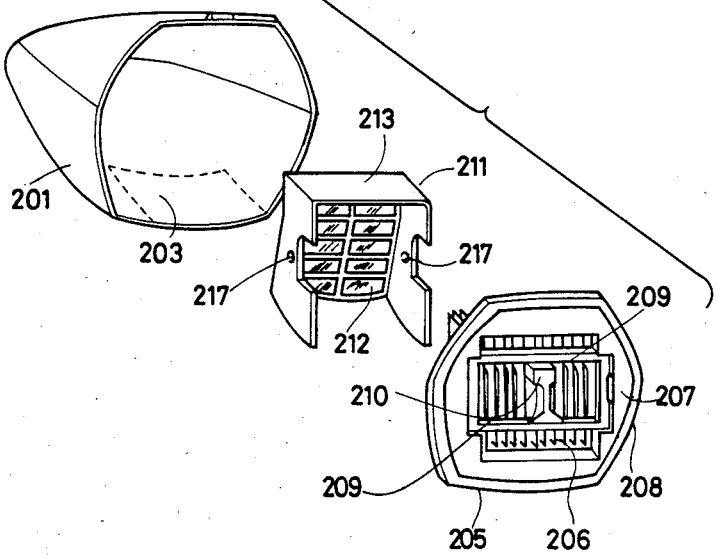
FIG. 6 is a perspective view of the front subassembly of the cleaner body shown in FIG. 1.

Referring next to FIG. 5, a comparison is made between the noise level characteristic of a conventional vacuum cleaner and that of the cleaner in the above embodiment. The graph shows the frequency characteristics of noise produced by the whole cleaner, i.e., the noise level (in dB) against the frequency (in Hz). The noise characteristic of the conventional cleaner is indicated by solid line A, while that of the cleaner in the above embodiment is indicated by broken line B. In general, the effect of the noise level produced by a fan motor depends strongly on the level in the range of 200 to 500 Hz. For the cleaner in the above embodiment, the noise level in this frequency range is low and hence vibration is satisfactorily suppressed. Also, the noise level in the vicinity of 10,000 Hz is low. As can be understood from the above comparison, because the motor unit 21 is securely fixed using screws and via the retaining ring 24, and because the unit 21 is pressed against the support rib 28′ together with the vibration suppressor 22, the effect of the vibration of the fan motor is greatly reduced. Further, the unit is sufficiently held in a cantilevered way by means of the support rib 28′, the rib or the like that supports the bearing of the motor is dispensed with. This prevents sinks from forming on the outer surface of the cleaner. Consequently, the appearance of the cleaner is not disfigured. In addition, as the fan cover 21*a* is pressed on the inner surface of the support rib 28′ via the vibration suppressor 22 made of rubber, and the space between the fan cover 21*a* and the rib 28′ is well sealed by the suppressor 22, enhancing the evacuating performance.

As thus far described, the vacuum cleaner in the above embodiment consists of the front subassembly 1, the central subassembly 2, and the rear subassembly 3 which are connected together. The motor unit 21 and the cord reel unit 23 are designed to be incorporated in the central subassembly 2 and so the rear subassembly 3 is not required to be provided with a rib that supports the motor unit 21 and the cord reel unit 23. This greatly simplifies the structure of the moldings for forming the central subassembly 2. That is, what should be provided in the subassembly 2 are only the rib 28 for anchoring the motor unit 21, and other parts. Consequently, there arises no possibility that sinks are produced on the outer surface of the rear subassembly 3 due to ribs, which aesthetically provides an overall good appearance.

Since sinks are not produced by ribs on the outer surfaces of the central subassembly 2 and the rear subassembly 3, the body of the cleaner can be fabricated from a resin such as polypropylene that exhibits a large coefficient of contraction and is inexpensive.

The central subassembly 2 of the body incorporating the motor unit 21 and the cord reel unit 23 are connected together by inserting screws into screw guides 29, 30, 100, etc. formed in the central subassembly 2, and securing screws to the tapped portion 36, etc. formed in the rear subassembly 3. The central subassembly 2 and the rear subassembly 3 connected together in this way constitute an exhaust body including the motor unit 21 serving as an evacuating device. The connection between the exhaust body and the front subassembly 1 is made using the clamp 10. Specifically, while the anchoring projection 12 is caught on the projection 11, the hook portion 18 of the clamp 10 is brought into engagement with the protrusion 19, whereby the front subassembly 1 is rigidly secured to the exhaust body. If the thumb piece 15 of the clamp 10 is pushed horizontally, the clamp 10 angularly moves about the shaft 14, and then the hook portion 18 disengages from the protrusion 19. As a result, the front subassembly 1 separates from the exhaust body. The clamping mechanism including the clamp 10 is disposed in the central subassembly 2 of the body as described above, and therefore a space for mounting the clamp 10 is not necessary for the front subassembly 1. Rather, the protrusion 19 on the outer periphery of the rear end portion suffices, thus dispensing with a rib for partitioning the space in which the clamping mechanism is received. Thus, the inner space of the front subassembly 1 can be effectively utilized, and it it possible to make the space C storing the drawn in dust as large as possible. Additionally, since no rib is formed to receive the clamping mechanism, the space above the main filter 8 is not narrowed, permitting the O ring 13 attached to the filter 8 to make reasonable contact with the back side of the rear end portion of the front subassembly 1. Hence, air leakage from around the filter 8 can be completely prevented.

Also, as described above, the cord reel cover 25 secures the cord reel unit 23 and covers the rear portion of the unit, and therefore the exhaust wind can be shielded. This can prevent the fine dust which passes through the main filter 8 from adhering to the cord reel unit 23. Further, since the opening 40 in the rear subassembly 3 cooperates with the protrusion 44 to form the plug takeout port 49 that acts as a cord stopper, no separate cord stopper is needed. Also, the assembly operation is effected easily. Furthermore, since the cord reel unit 23 is covered and held by the cord reel cover 25, neither the central subassembly 2 nor the rear subassembly 3 requires a rib for supporting the cord reel unit 23. As a consequence, it is not possible that ribs incur the formation of sinks on the outer surface, thus maintaining an overall good appearance. Also, as no complex ribs are formed, the time taken to cool the central subassembly 2 and the rear subassembly 3 during the molding operation can be shortened substantially. This permits a decrease in the cost to manufacture the body.

A vacuum cleaner having an improved filter in the front subassembly 1 on the suction side is next described with reference to FIGS. 6–9. A dust case 201 corresponding to the front subassembly 1 of the body in the above embodiment has a suction port 202, in which a hose is inserted, in the front surface. An opening 203 is formed at its rear end. A swivel wheel 204 is mounted to the bottom of the case. A main filter 205 is detachably fitted in the opening 203 at the rear end of the case 201. The filter 205 is composed of a sheet of corrugated paper filter 206, a filter frame 207 that supports the sheet, and an O ring 208 fitted on the outer periphery of the frame 207. The main filter is fitted in the opening 203 at the rear end of the dust case 201 via the O ring 208 in an airtight manner. Upper and lower support arms 209 are molded integrally with the frame 207 and extend laterally on the back side of the filter paper 206. A dust shaker 210 is supported by the arms 209 so as to be slidable horizontally. When the shaker 210 is reciprocated horizontally, it knocks and shakes the top of the filter paper 206 to cause the dust to fall from the paper. A prefilter 211 has a net type filter surface 212 and a partition wall 213 that covers the back side of the surface 212 from the top toward both sides. The prefilter 211 is installed on the front side of the main filter 205 to form a fine dust-collecting chamber 214 therebetween, the chamber being open at its lower end. The filter surface 212 of the prefilter 211 is slightly tilted toward the bottom, so that the bottom of the chamber 214 is enlarged as compared with the top. The main filter 205 is fitted in the opening 203 at the rear end of the dust case 201 and received in it. Under this condition, by bringing the lower end of the main filter 211 into contact with the inner bottom of the dust case 201, the lower opening of the collecting chamber 214 is closed and, at the same time, a coarse dust-collecting chamber 215 is defined in the case 201. Both sides of the filter frame 207 have protrusions 216 which can engage holes 217 extending through both side portions of the partition wall 213. The filters are installed by inserting the protrusions 216 into the holes 217, and they can be separated at will.

The air flow created by the motor-driven blower is directed from the suction port 202 toward the filters 211 and 205. When the flow passes through the filters, coarse dust is captured by the filter surface 212 and stored in the coarse dust-collecting chamber 215. Fine dust is captured by the filter paper 206 and stored in the fine dust-collecting chamber 214.

The collected dust is dumped in the manner described below. First, the dust case 201 is separated from the body of the cleaner, and then the dust shaker 210 is rocked to cause the dust to fall from the main filter 205. Since the filter surface 212 of the prefilter 211 is tilted in such a way that the fine dust-collecting chamber 214 is broader toward its bottom, even the dust choked between the filter surface 212 and the filter paper 206 can easily be removed in the downward direction by vibration, and then it is stored in the lower portion of the chamber 214. Thereafter, the main filter 205 and the prefilter 211 are taken out of the dust case 201. At this time, fine dust can readily be left within the dust case 201 without scattering fine dust outside the case 201 by paying attention to the open bottom, because the chamber 214 is open only at its bottom. After the filters 205 and 211 are taken out in this way, coarse and fine dust are removed through the opening 203 at the rear end.

In the embodiment described just above, the prefilter 211 is required to make contact with the inner surface of the dust case 201 only at its bottom to separate the collecting chamber 214 from the chamber 215. Further, because of the structure where the lower end of the prefilter 211 is in direct contact with the inner bottom of the case 201, ribs which are in contact with the prefilter 211 and partitions the collecting chambers 214 and 215 are in no way required. Further, formation of sinks on the dust case 201 molded out of synthetic resin does not take place, because such ribs are not formed. It is also possible to form a rib integrally with the inner bottom of the dust case 201 such that the lower end of the prefilter 211 is in contact with the rib.

Figure 10:
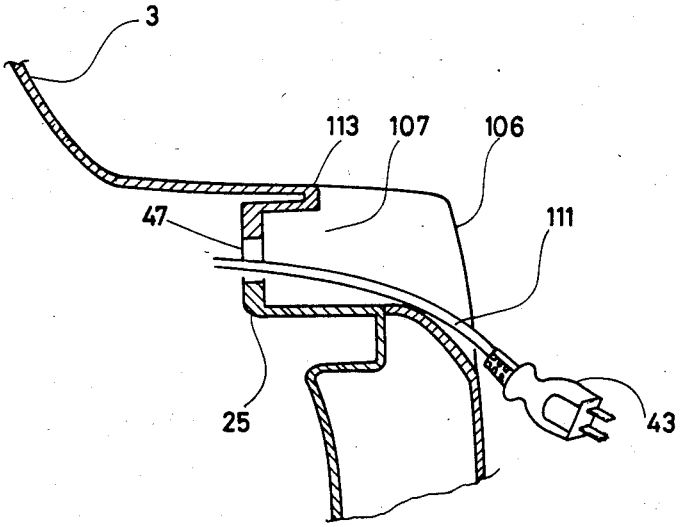
FIG. 10 is a fragmentary cross section of an improved structure from which a power cord is unwound.
Figure 7:
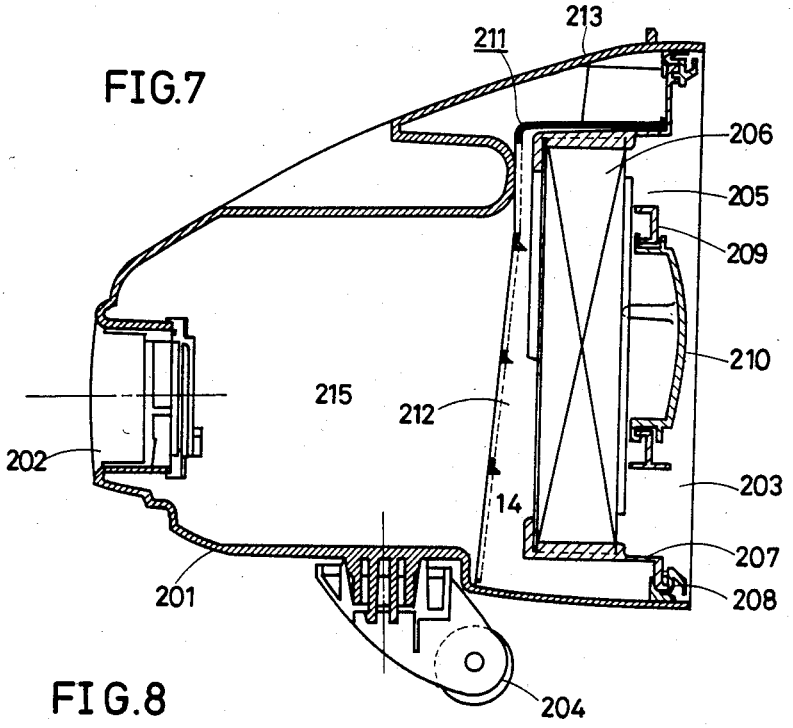
FIG. 7 is a cross-sectional view of the front subassembly of the cleaner body shown in FIG. 1.
Figure 8:
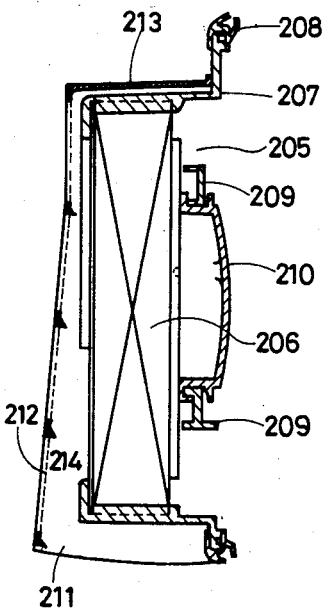
FIG. 8 is a cross-sectional view of the filter unit shown in FIGS. 6 and 7.
Figure 9:
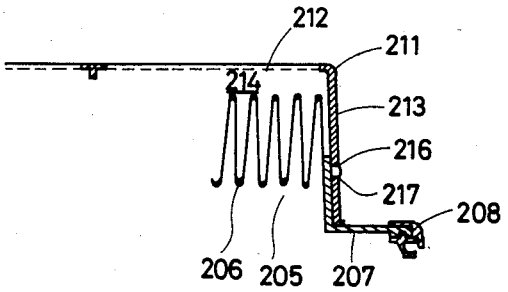
FIG. 9 is a cross-sectional view of the structure for mounting the main filter and prefilter of the cleaner shown in FIG. 1.
Figure 11:
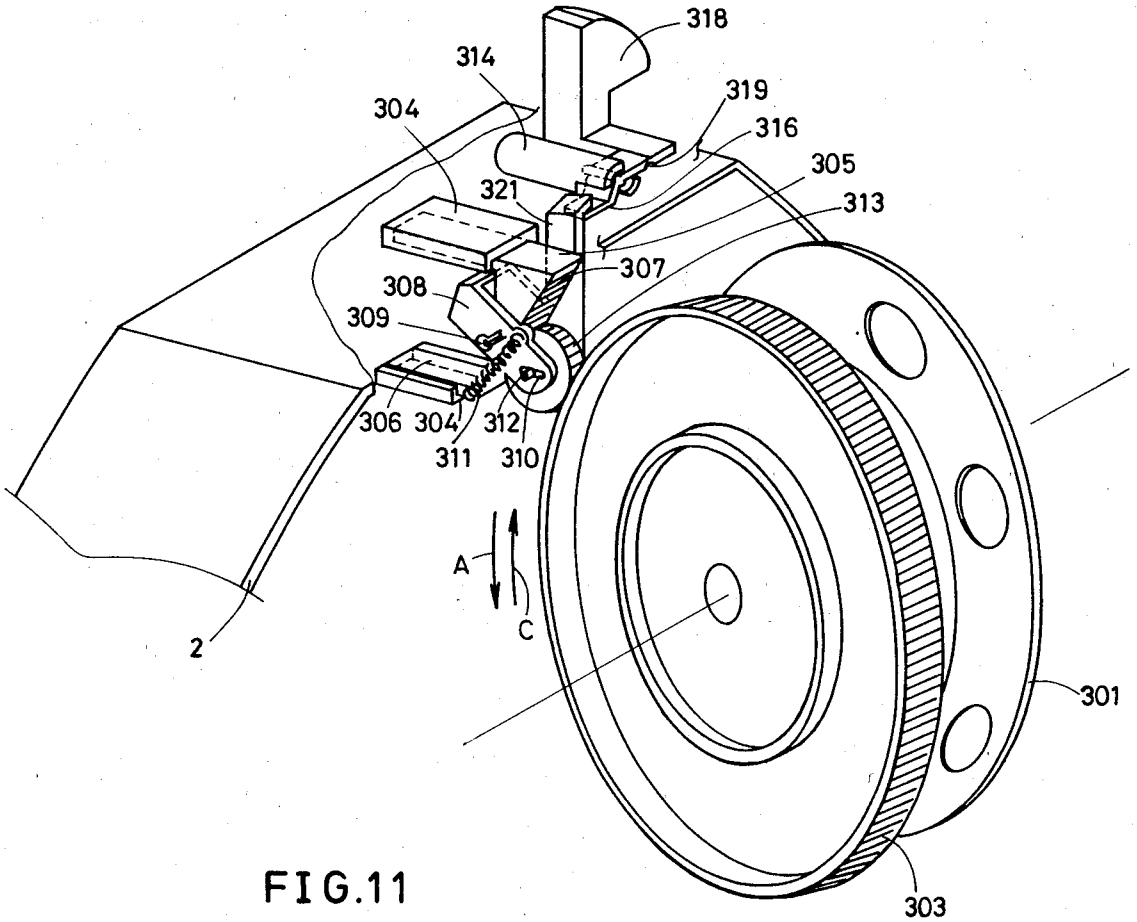
FIG. 11 is a perspective view of the device for locking the cord reel used in the vacuum cleaner of the present invention.
Figure 12:
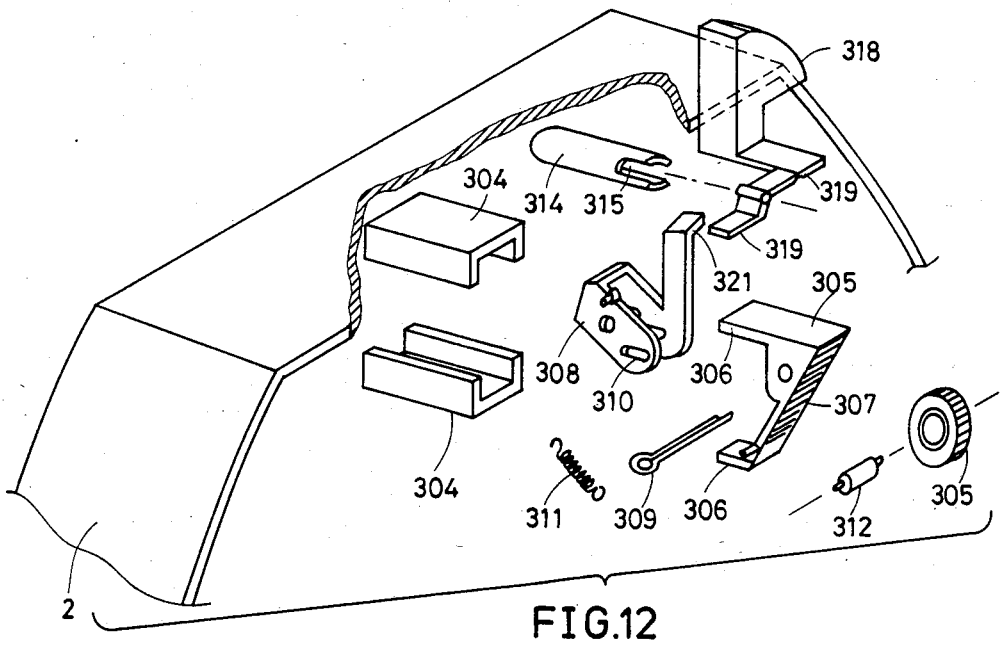
FIG. 12 is an exploded view of the locking device shown in FIG. 11.
Figure 13:
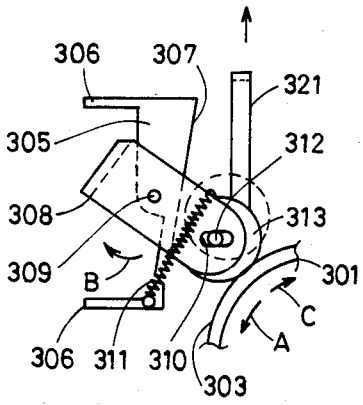
FIG. 13 is a view showing the relation of the cord reel to the locking roller of the locking device shown in FIG. 11.
Figure 14:
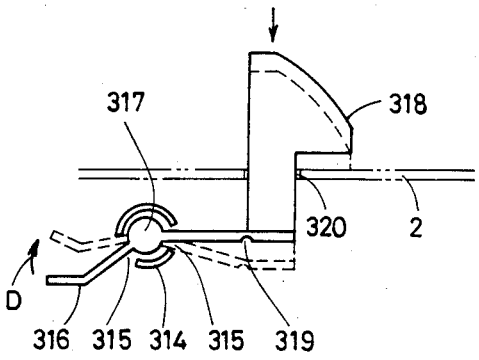
FIG. 14 is a view showing the structures of the unlocking lever and of the unlocking button of the locking device shown in FIG. 11.

Referring next to FIG. 10, there is shown an improvement over the structure of the power cord takeout portion shown in FIG. 4. A recess 107 extends from the upper surface of the rear subassembly 3 of the cleaner body to a peripheral side surface, such as the rear end surface, and it is just large enough to receive a power plug (described later). The recess 107 is formed by the rear subassembly 3 and the cord reel cover 25 of the cord reel unit 23, the cover 25 constituting a part of the bottom wall of the recess 107 as well as a part of the front wall. A cord takeout port 47 is formed across the junction of the rear subassembly 3 and the cover 25. Indicated by reference numeral 111 is the aforementioned power cord that is brought out from the takeout port 47. This cord has a power plug 43 at its front end. A wall 113 extends outward, in the direction that the power cord is pulled out, and above the cord takeout port 47. The wall 113 is formed integrally with the rear subassembly 3.

In the above-mentioned structure, the power plug 43 lies on the upper surface of the body of the cleaner, and therefore it is easy to grasp the plug 43 and to pull out the power cord 111. Further, the cord 111 is pulled out in a direction close to horizontal. Even if the cord makes contact with the wall 113, only a small frictional resistance is produced. Thus, the cleaner is much easier to operate than the conventional cleaner. Also, the power cord 111 will not undergo any damage when it is slid or bent. Furthermore, the power cord 111 can be wound up smoothly, because the movement of the cord 111, especially the upward movement, is limited by the wall 113. It is to be noted that the recess 107 can be formed otherwise than the foregoing. For instance, it may be formed in such a way that it extends from the upper surface of the rear subassembly 3 to one side surface.

Referring next to FIGS. 11–14, a device for braking the rotation of the cord in the cord reel unit 23 when the cord is taken up is hereinafter described in detail. The cord reel is indicated by reference numeral 301, and is rotatably held within the central subassembly 2 of the body of the cleaner. This reel is always urged toward the direction of take-up, i.e., in the direction indicated by the arrow A, by a coiled spring (not shown). The outer periphery of the reel is provided with a flange 303. A pair of support projections 304 are formed integrally with the inner surface of the central subassembly 2. The U-shaped projections 304 are opposed to and spaced a certain distance from each other. A U-shaped brake receiving plate 305 has a pair of legs 306 fitted in the insides of the respective support projections 304. The plate 305 also has a pressure-receiving surface 307 opposed to the flange 303 of the cord reel 301. The space between the surface 307 and the flange 303 is made narrower in such a direction that the cord is wound up on the cord reel 301. A U-shaped plate 308 interlocks with the braking operation, and its arms are located on the opposite sides of the plate 305 and secured to it by a split pin 309 so as to be rotatable about the pin. A slot 310 is formed in the front portion of each of the arms. A spring 311 has one end anchored to the receiving plate 305, the other end being secured to the interlocking plate 308. The spring acts to invariably bias the interlocking plate 308 in the direction indicated by the arrow B. A shaft 312 is inserted in the slots 310 in the interlocking plate 308 and supports a locking roller 313 between both arms of the plate 308. As is well known in the prior art, the roller 313 is always wedged in between the flange 303 of the cord reel 301 and the surface 307 of the receiving plate 305 by the action of the spring 311 as indicated by the solid line in FIG. 13. Since the surface 307 and the flange 303 with which the roller 313 makes contact exert a resistance on the roller, the cord reel 301 is braked and kept in locked condition. The force of the coiled spring that acts on the reel 301 in the direction of take-up of the cord functions to wedge the roller 313 further deep to between the flange 303 and the pressure-receiving surface 307. If the roller 313 is rotated toward the direction to pull out the cord as indicated by the arrow C, the roller is driven out from between the flange 303 and the surface 307 against the action of the spring 311 as indicated by the broken line in FIG. 13. Thus, the reel 301 is turned smoothly in the direction of the arrow C.

A hollow boss 314 is formed integrally with the inner surface of the central subassembly 2. A pair of spaced grooves 315 is formed in the front end portion of the boss. An unlocking lever 316 has a pivot 317 fitted in the boss 314. Both ends of the lever 316 extend outwardly through the grooves 315. The lever 316 can rotate on its pivot 317 within the range permitted by the width of the grooves 315. An unlocking button 318 is molded integrally with the lever 316 via a thin-walled hinge 319 and extends from one end of the lever 316 outwardly through a button hole 320 formed in the upper surface of the housing 2 of the appliance. The lever 316 and the button 318 are integrally molded out of an elastic synthetic resin such as polyethylene or polypropylene. One arm of the interlocking plate 308 has an extension 321 whose front end is bent so as to engage the free end of the lever 316.

In the locking device constructed as described above, if the unlocking button 318 is operated to rotate the unlocking lever 316 in the direction indicated by the arrow D while the cord has been pulled out. Then, the plate 308 that interlocks with the lever 316 via the extension 321 is rotated against the action of the spring 311, setting free the locking roller 313 from the flange 303. Thus, the cord reel 301 is unlocked. Then, the reel 301 is rotated in the direction indicated by the arrow A by the coiled spring, and automatically winds up the cord.

The aforementioned unlocking button 318 is used to rotate the unlocking lever 316. In an alternative arrangement, the button 318 may be depressed straight due to the action of the hinge 319. Accordingly, the shape and size of the button hole 320 may vary according to the button 318.

Figure 17:
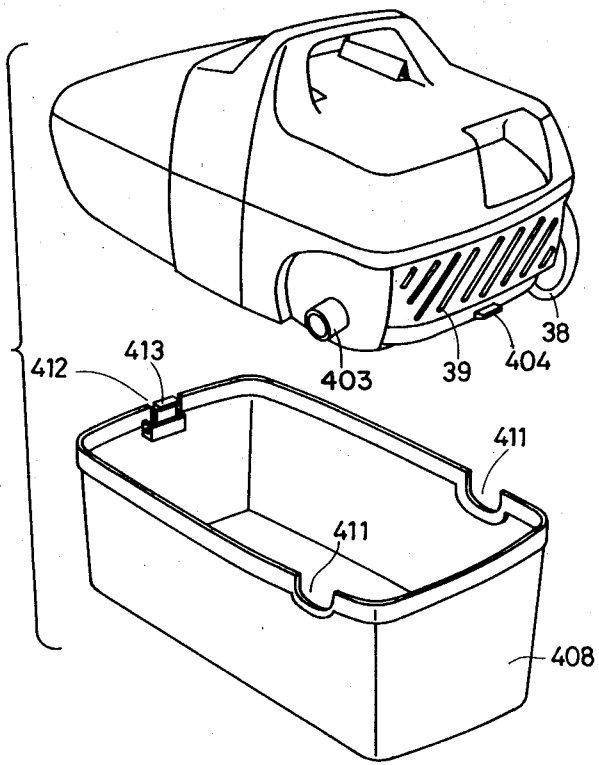
FIG. 17 is a view showing the relation between the cleaner and the case shown in FIG. 15.
Figure 15:
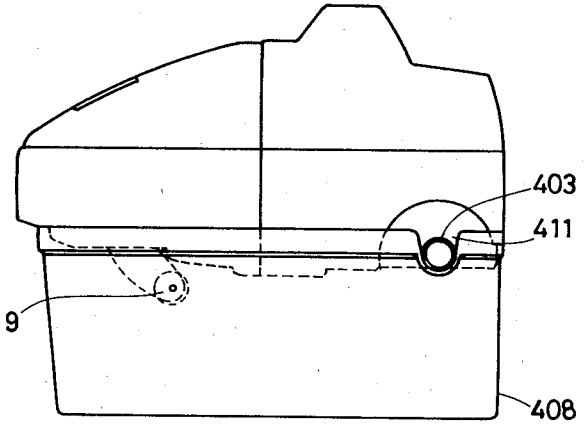
FIG. 15 is a side elevation of a vacuum cleaner according to the present invention, for showing the manner in which the cleaner is received in a case.
Figure 16:
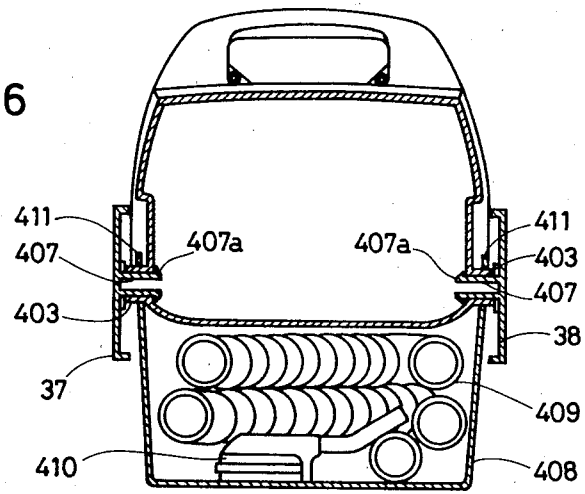
FIG. 16 is a longitudinal cross section of the main portions of the cleaner shown in FIG. 15.

Referring next to FIGS. 15–17, there is shown another embodiment of the invention where the bottom of the cleaner body is detachably mounted in the opening formed in the upper surface of a storage case by a clamping device. Two cylindrical bosses 403 protrude laterally from the opposite sides of the rear lower portion of the body. A protrusion 404 for engaging purposes is formed on the lower portion of the rear end of the body. A similar protrusion (not shown) is formed on the lower portion of the front end of the body. Two rear wheels each of which has an axial groove are molded integrally with their respective axles 407. Each of the wheels has a claw 407*a* at its front end, and is rotatably mounted by inserting the axles 407 in the bosses 403 and bringing the claws 407*a* into engagement with the inner ends of the bosses 403. A case 408 for receiving accessaries such as dust hoses 409 and a suction port attachment 410 for cleaning floors is made from synthetic resin. The upper fringes of both side walls of the case 408 are provided with notches 411 in which the bosses 403 fit. The case 408 is equipped with a clamping device 412 that is composed of a rotatable clamping member 413 and a spring (not shown) for always urging the clamping member 413 into engagement with the aforesaid protrusion on the front side of the body of the cleaner. The case 408 has a protrusion (not shown) which comes into engagement with the upper surface of the protrusion 404 in a position opposite to the clamping device 412.

In the structure described above, when the body of the cleaner is to be installed in the case 408, the protrusion 404 is first brought into engagement with the protrusion on the case 408 while the front portion of the body of the cleaner is slightly raised. Then, the front portion of the body is lowered to bring the protrusion on the front side into engagement with the clamping member 413. This operation is made easy by the bosses 403 and the notches 411 which act as guide means.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A vacuum cleaner comprising:

a body member divided into a front subassembly having an exhaust side and containing a suction port, said front subassembly defining a case for collecting dust, a central subassembly removably connected to the exhaust side of the front subassembly, said central subassembly containing a fan means acting as an evacuating device, a cord reel unit connected to the fan means, said cord reel unit being provided with a cord reel cover and vertically positioned adjacent to the fan means, whereby the cord reel unit is fixed to said fan means via the cord reel cover, said cord reel cover screening the exhaust gas from said cord reel unit, and a rear subassembly removably connected to the central subassembly and functioning to cover the rear side of the fan means disposed in the central subassembly, said rear subassembly containing an exhaust port for removing exhaust gas therefrom.

2. The vacuum cleaner of claim 1, further comprising:

a clamp disposed on the outer surface of the front end of the central subassembly and pivotally mounted to the central subassembly, the clamp having a hook portion at its front end for engaging purposes;

a spring mounted to the central subassembly, said spring being arranged and positioned to bias the hook portion of the clamp inwardly of the central subassembly; and a protrusion formed opposite to the clamp and on the outer surface of the rear end of the front subassembly;

wherein the hook portion is in engagement with the protrusion while the rear end of the front subassembly is in contact with the front end of the central subassembly to connect the front subassembly to the central subassembly.

3. The vacuum cleaner of claim 1, wherein the fan means includes a fan motor and a fan cover coupled thereto, said fan cover positioned to directly cover the fan motor.

4. The vacuum cleaner of claim 3, further comprising:

a support rib formed within the central subassembly and opposed to the outer periphery of the fan cover;

a shock-absorbing member covering the outer periphery of the fan cover and interposed between the outer periphery of the cover and the support rib; and a holding member disposed on the outer periphery of the fan cover and cooperating with the shock-absorbing member to press the fan cover against the support rib, thereby holding the fan means.

5. The vacuum cleaner of claim 1, wherein the cord reel cover has a cover surface that covers the surface of the cord reel, said cover surface being provided with a protrusion which is formed on the cover surface and closes a part of an opening formed in the central subassembly, said opening and protrusion being arranged to define a cord takeout port.

6. The vacuum cleaner of claim 5, wherein a fan motor-retaining portion is formed integrally with the cord reel cover and fixedly holds the fan means in the central subassembly by attachment of the cover to the central subassembly.

7. The vacuum cleaner of claim 1, wherein the cord reel unit includes a locking device that acts to brake the cord reel when the cord is being wound up on the reel, the locking device being caused to unlock the cord reel by the rotation of an unlocking lever.

8. The vacuum cleaner of claim 7, wherein said locking device has an unlocking button molded out of a synthetic resin and integral with said unlocking lever via a thin-walled hinge, the button extending outwardly from one end of the locking lever through a hole formed in the cord reel unit, the unlocking button acting to rotate the unlocking lever when it is depressed.

9. The vacuum cleaner of claim 1, further comprising;

a main filter detachably fitted via an O ring into an opening formed at the rear end of the front subassembly;

a dust shaker disposed on the back side of the main filter so as to cause dust to fall from the main filter;

a prefilter having a filter surface at least on its front side and a partition wall that covers the back side of the filter suface from the top to both sides thereof, said prefilter being disposed on the front side of the main filter; and a fine dust-collecting chamber formed between the filters and being open at its lower end, the lower fringe of the prefilter contacting the bottom of a dust case to close the lower opening of the fine dust-collecting chamber while both filters are received in the front subassembly of the body member.

10. The vacuum cleaner of claim 9, wherein the front surface of the prefilter is tilted such that the fine dust-collecting chamber is gradually enlarged toward its bottom.

11. The vacuum cleaner of claim 1, wherein the body member of the cleaner further contains:

a recess extending from the top of the body member to the peripheral side surface, said recess being formed by an upwardly extending wall, a cord takeout port formed in the upwardly extending wall that forms the recess, and a wall extending above the cord takeout port and in the same direction that a power cord is pulled out.

12. The vacuum cleaner of claim 1, further comprising front wheels and rear wheels attached to the body member.

13. The vacuum cleaner of claim 12, wherein a hollow case is removably attached to the bottom of the body member for housing vacuum attachments.

14. The vacuum cleaner of claim 13, wherein bosses through which the axles of the rear wheels pass are formed on both sides of the body member of the cleaner, and wherein the upper ends, on opposite sides of the case that receives the body member are provided with notches in which the bosses fit.

* * * * *